US005424811A

United States Patent [19]

Haneda

[11] Patent Number: 5,424,811

[45] Date of Patent: Jun. 13, 1995

[54] CHARGELESS IMAGE FORMING APPARATUS INCLUDING TONER REMOVAL FROM PHOTORECEPTOR

[75] Inventor: Satoshi Haneda, Hachioji, Japan

[73] Assignee: Konica Corporation, Tokyo, Japan

[21] Appl. No.: 22,905

[22] Filed: Feb. 26, 1993

[30] Foreign Application Priority Data

Mar. 2, 1992 [JP] Japan ..... 4-044616
Mar. 11, 1992 [JP] Japan ..... 4-052664

[51] Int. Cl.[6] ..... G03G 15/09

[52] U.S. Cl. ..... 355/251; 347/140; 355/245

[58] Field of Search ..... 355/210, 245, 251, 253, 355/269, 270; 118/644, 652, 656, 657, 661; 346/153.1, 160

[56] References Cited

U.S. PATENT DOCUMENTS 4,545,669 10/1985 Hayes et al. ..... 355/253
4,769,676 9/1988 Mukai et al. ..... 118/652 X
4,844,008 7/1989 Sakemi et al. ..... 355/253 X
4,901,116 2/1990 Haneda et al. ..... 355/253
4,935,784 6/1990 Shigehiro et al. ..... 355/253
5,053,821 10/1991 Kunugi et al. ..... 355/245
5,138,387 8/1992 Sato et al. ..... 355/251
5,172,163 12/1992 Yamaoki et al. ..... 355/210
5,182,601 1/1993 Hodoshima et al. ..... 355/270

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

An imagewise exposure device exposes the inner surface of a rotating photoreceptor. A developer layer is provided around the surface of a first developing roller to which a DC voltage, the polarity of which is the same as that of charge given to the insulating toner of the developer, is applied. The developer layer on the first developing roller contacts the outer surface of the photoreceptor, corresponding to the inner surface exposed, so that a toner layer is formed on the outer surface of the photoreceptor. A toner image is formed when a developer layer provided around a second developing roller contacts the outer surface of the photoreceptor on which the toner layer is formed, wherein a DC voltage having polarity reverse to that of the first developing roller is applied to the second developing roller.

13 Claims, 9 Drawing Sheets

CHARGELESS IMAGE FORMING APPARATUS INCLUDING TONER REMOVAL FROM PHOTORECEPTOR

BACKGROUND OF THE INVENTION

The present invention relates to a chargeless image forming apparatus, and more particularly relates to an image forming apparatus characterized in that: an image exposure means irradiates light onto the inner surface of a rotating photoreceptor; a developer layer held on the surface of a developing roller is contacted with the outer surface of the photoreceptor, the inner surface of which has been irradiated with exposure light, so that a toner image is formed on the outer surface of the photoreceptor; and the toner image is transferred and fixed onto the surface of a transfer sheet sent onto the outer surface of the photoreceptor.

Conventional chargeless image forming apparatus use conductive toner. However, the chargeless image forming apparatus of the prior art is disadvantageous in that electrical transfer is difficult to be carried out.

Further, the present invention relates to an image forming apparatus characterized in that: image exposure is repeatedly carried out on the inner surface of a photoreceptor by an image exposure means along a line approximately perpendicular to the rotational direction of the photoreceptor; and a developer layer provided around a developing roller upon which a bias voltage is impressed, is opposed to a portion of the outer surface of the photoreceptor, wherein the portion corresponds to the position of the aforementioned line along which image exposure has been carried out, so that a toner image is formed on the outer surface of the photoreceptor.

SUMMARY OF THE INVENTION

It is a primary object of the present invention to provide a chargeless image forming apparatus by which a clear image without gray background can be formed with insulating toner and the formed image can be efficiently transferred onto a transfer sheet by means of electrical transfer.

The first embodiment of the image forming apparatus of the present invention is composed in the following manner: An image exposure means irradiates light onto the inner surface of a rotating photoreceptor. A developer layer is provided around the surface of a first developing roller upon which a DC voltage, the polarity of which is the same as that of the insulating toner of the electrically charged developer, is impressed. The aforementioned developer layer on the first developing roller is contacted with the outer surface of the photoreceptor, onto the inner surface of which the aforementioned image exposure light is irradiated, so that a toner layer is formed on the outer surface of the photoreceptor. A toner image is formed by a developer layer provided around a second developing roller, which is contacted with the outer surface of the photoreceptor on which the aforementioned toner layer is formed, wherein a DC voltage, the polarity of which is reverse to that of the first roller, is impressed upon the second developing roller.

As described above, the chargeless image forming apparatus of the present invention includes: a first developing roller upon which a DC voltage, the polarity of which is the same as that of the insulating toner of the developer layer, is impressed; and a second developing roller upon which a DC voltage, the polarity of which is reverse to that of the insulating toner of the developer layer, is impressed, the second developing roller being disposed downstream of the first developing roller. Therefore, the developer layer provided around the second developing roller removes the toner deposited on the non-exposure portion on the photoreceptor surface to which an electrical charge has not been given, wherein the toner in the exposed portion, to which an electrical charge has been given by the image exposure means, is not removed. Accordingly, a clear toner image without gray background can be formed, and the formed toner image can be efficiently transferred onto a transfer sheet by means of electrical transfer.

The second embodiment of the image forming apparatus of the present invention is composed as follows.

Insulating toner is used for the developer of the image forming apparatus. AC voltage is applied to the bias voltage to be impressed upon the developing roller while the developing means forms a toner image, wherein the AC voltage is synchronized with the repetition of image exposure conducted by the image exposure means in such a manner that: the polarity of AC voltage is the same as that of charged toner during the period of image exposure; and the polarity of AC voltage is reverse to that of charged toner in the period between image exposure operations.

In the chargeless image forming apparatus of the present invention, the polarity of the bias voltage given to the developing roller is reverse to that of the charged toner during the period between an image exposure operation carried out along the line and the successive image exposure operation. Therefore, the toner deposited in the nonexposure portion on the outer surface of the photoreceptor where the electrical charge was not moved to the photosensitive layer by the image exposure carried out along the line, is attracted to the developing roller side. On the other hand, the toner deposited on the outer surface of the photoreceptor where the electrical charge was moved remains as it is, so that a clear toner image without dirt can be formed. Since the insulating toner is used, the toner image can be efficiently transferred on the transfer sheet by means of electrical transfer.

DETAILED DESCRIPTION OF THE PREFERRED EMBODIMENTS

With reference to an example shown in the attached drawings, the present invention will be explained as follows.

Figure 1:
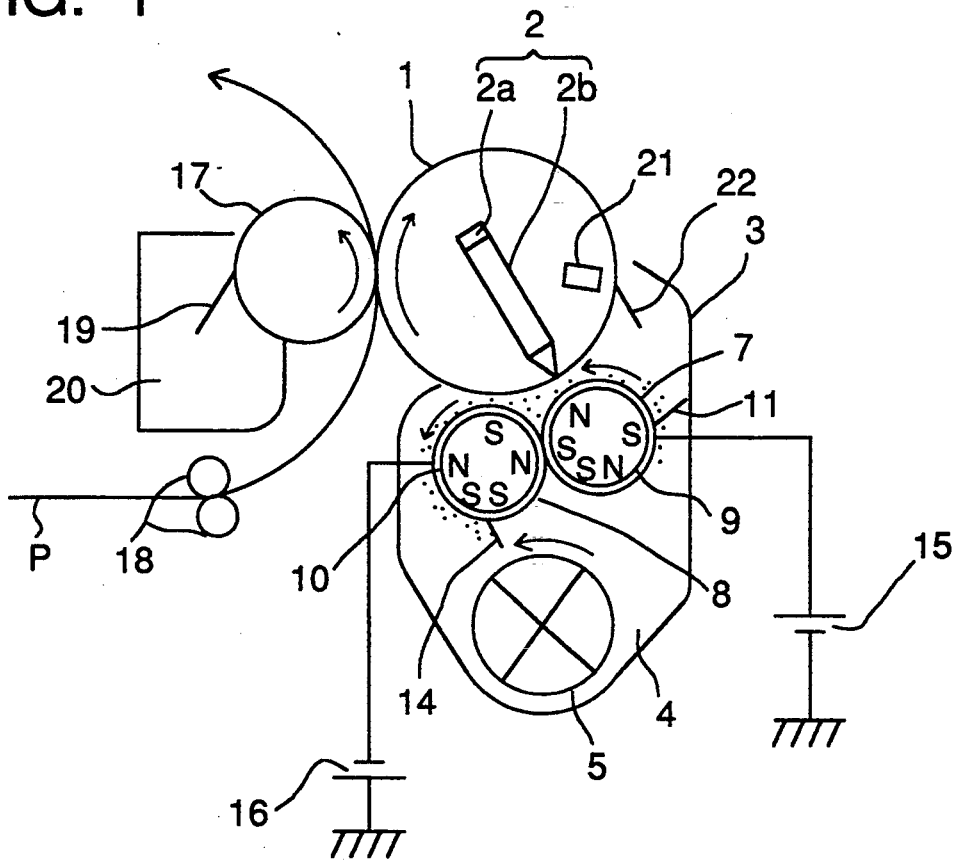
FIG. 1 is a schematic illustration of an essential portion of an example of the image forming apparatus of the present invention.
Figure 2:
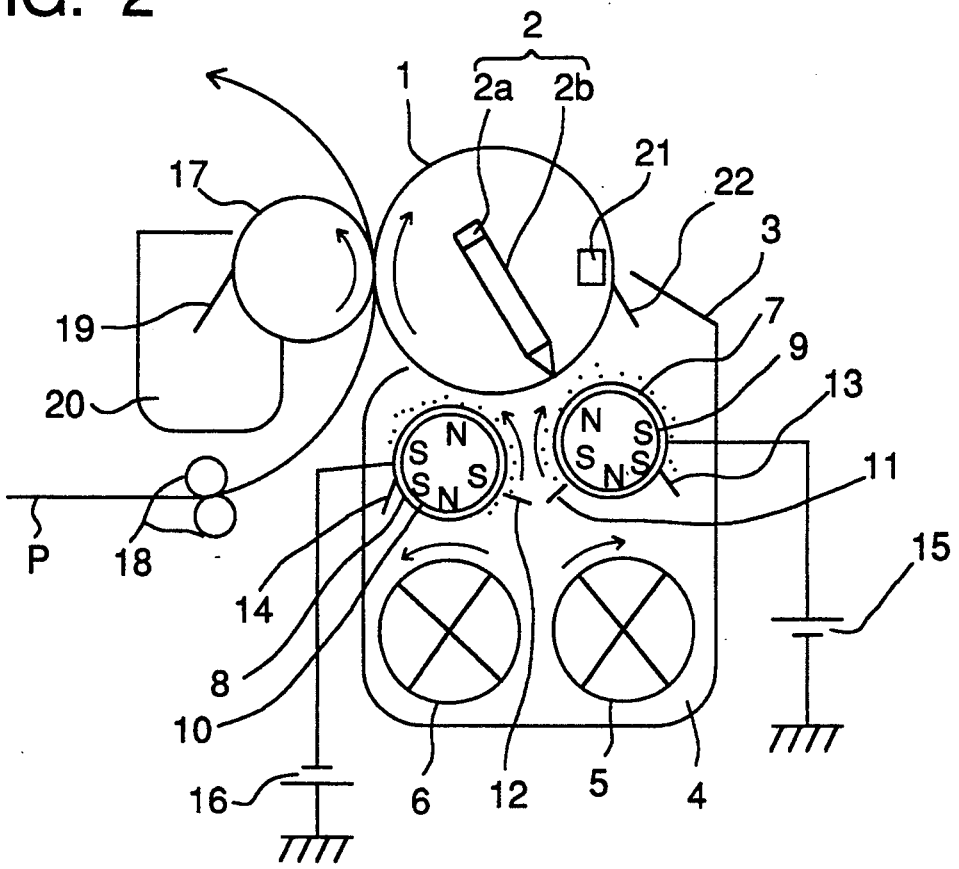
FIG. 2 is a schematic illustration of an essential portion of another example of the image forming apparatus of the present invention.
Figure 3:
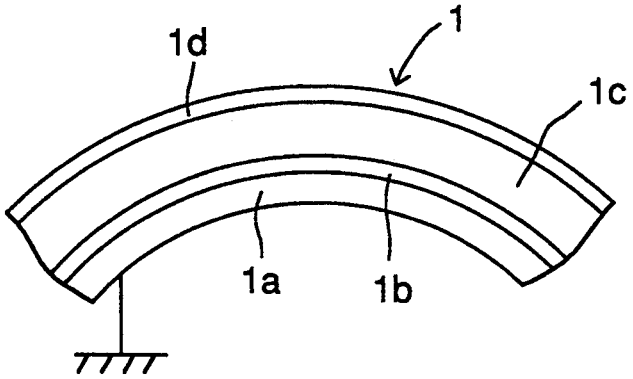
FIG. 3 is a schematic illustration of a portion of a photoreceptor.

FIGS. 1 and 2 are respectively a schematic illustration of an essential portion of examples of the image forming apparatus of the present invention. FIG. 3 is a schematic illustration of a portion of a photoreceptor. Numeral 1 shown in FIGS. 1 and 2 is a photoreceptor drum that is rotated in the arrowed direction. As shown in FIG. 3, the photoreceptor drum 1 is composed of a photoconductive layer including a transparent electrode layer 1*a*, an electrical charge generation layer 1*b*, a positive hole electrical charge transport layer 1*c* and an electrical charge generation layer 1*d*.

Numeral 2 is an image exposure means composed of a light emitting array 2*a* such as LED and EL and also composed of a convergent optical transmitter 2*b* such as a rod lens array, and the image exposure means 2 is stationarily provided inside the photoreceptor drum 1. When the light emitting element of the light emitting element array 2*a* is selectively lit in accordance with image data, image light is incident upon the inner surface of the photoreceptor drum 1 in a direction perpendicular to the rotational direction of the photoreceptor drum 1. Numeral 3 is a developing unit case, the lower portion of which is a developer reservoir 4. Numerals 5 and 6 are stirring blade rollers that stir the 2-component developer composed of insulating toner and magnetic carrier accommodated in the developer reservoir 4, or stir the 1-component developer composed of magnetic or nonmagnetic insulating toner so that the toner can be charged and at the same time the developer is supplied onto the surfaces of the first and second developing rollers 7 and 8.

The first and second developing rollers 7 and 8 are made of nonmagnetic conductive material such as aluminum. In the developing rollers 7 and 8, magnets 9 and 10 are respectively provided in such a manner that the N and S poles are disposed in the circumferential direction. Developer is attracted onto the surfaces of the developing rollers 7 and 8 by the magnetic force of the magnets 9 and 10. When the first and second rollers 7 and 8 are respectively rotated in the arrowed direction, the developer is conveyed in the arrowed direction, so that a developer layer is formed on the developing rollers 7 and 8. In the case of the first developing roller 7, the developer layer is contacted with a portion on the outer surface of the photoreceptor drum 1 corresponding to a portion irradiated with image light emitted from the image exposure means 2. In the case of the second developing roller 8, the developer layer is contacted with a portion on the outer surface of the photoreceptor drum 1, wherein the portion is located on the downstream side with respect to the portion where the first developing roller is contacted with the photoreceptor drum 1.

Figure 4:
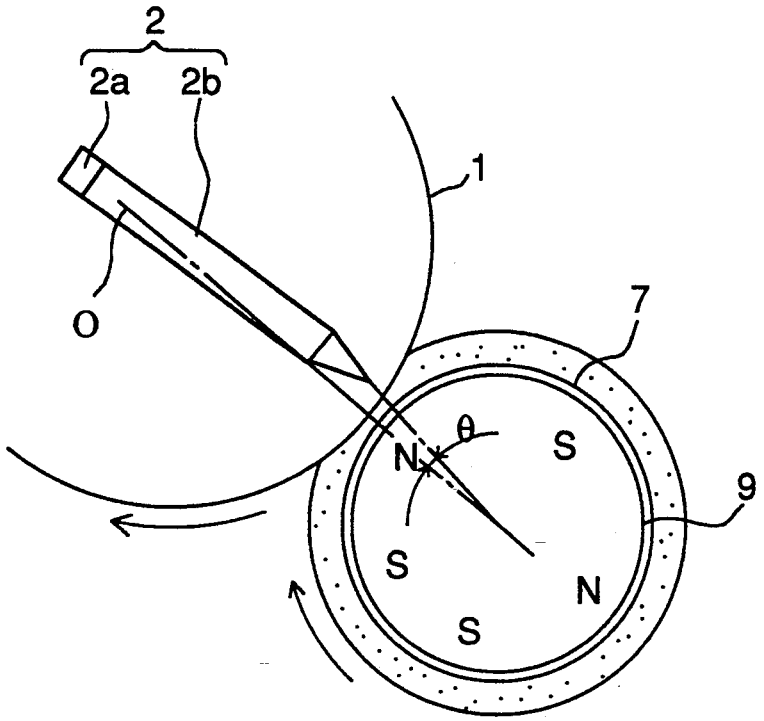
FIG. 4 is a partial enlarged view of FIG. 1 or FIG. 2.

A relation between the position where image light emitted from the image exposure means 2 is incident on the photoreceptor drum 1, and the position where the first developing roller is contacted with the developer layer, is shown in FIG. 4 that is a partial enlarged view of FIG. 1 or FIG. 2. As shown in FIG. 4, it is preferable that an image light incidence position is located on the upstream side with respect to a position where the distance between the surface of the first developing roller 7 and the photoreceptor drum 1 is the shortest. In this case, an angle formed between a line connecting the center of the photoreceptor drum 1 with the center of the first developing roller 7, and a line connecting the image light incidence position with the center of the developing roller 7, is restricted in a range of $0 \leqq \theta \leqq 20°$. As a result of the foregoing, the electrical charge is efficiently transferred from the first developing roller to the photoreceptor drum 1 through the developer layer. Therefore, the electrical charge moving time can be ensured in the photoconductive layer. In the case where $\theta$ is increased to larger than 20°, the electrical field intensity is weakened, and the electrical charge can not be transferred satisfactorily. In the case where the image light incidence position is located on the downstream side with respect to the position where the distance between the photoreceptor and the developing roller is the shortest, the electrical charge transfer time can not be sufficiently provided.

Numerals 11 and 12 are respectively layer thickness regulating blades that regulate the thickness of the developer layers on the first and second developing rollers 7 and 8. In the case of the developing roller 8 shown in FIG. 1, the layer thickness regulating blade 12 is not provided, because the second developing roller 8 receives a developer layer from the first developing roller 7 right after the developer layer has passed a position where the first developing roller 7 is contacted with the outer surface of the photoreceptor drum 1.

Numerals 13 and 14 are scraper blades that scrape off the developer layer from the surfaces of the first and second developing rollers 7 and 8 after the developer layer has passed through the contacting position where the developing roller is contacted with the photoreceptor drum. However, in the case of the first developing roller 7 shown in FIG. 1, the scraper blade 13 is not provided, because the first developing roller 7 delivers a developer layer to the second developing roller after the developer layer has passed through the contacting position where the developing roller is contacted with the photoreceptor drum.

DC voltage, the polarity of which is the same as that of the charged toner in the developing layer, is impressed upon the first developing roller 7. In the case illustrated in the drawing, positive DC voltage of 300 to 1500 V is impressed upon the first developing roller 7. As a result of the foregoing, when the photoreceptor 1 is irradiated with image light emitted from the image exposure means 2, an electrostatic latent image is formed on the outer surface of the photoreceptor 1, and toner is deposited not only on the electrostatic latent image but also on the background portion.

A DC voltage of 50 to 300 V, the polarity of which is reverse to that of the charged toner in the developer layer, that is, the polarity of which is reverse to that of the voltage impressed upon the first developing roller, is impressed upon the second developing roller 8 by the bias power source 16. As a result of the foregoing, the developer layer on the second developing roller 8 removes all the toner deposited in the nonexposure portion on the photoreceptor 1 to which the electrical charge was not given while the developer layer on the second developing roller 8 does not remove the toner deposited in the exposure portion to which the electrical charge was given when the portion was irradiated with image light. Therefore, the toner image on the photoreceptor drum 1 previously formed by the developer layer on the first developing roller 7 can be made clear without any stains.

In the aforementioned developing operation, the toner contained in the developer layer on the first developing roller 7 is consumed, and the toner on the photoreceptor drum 1 is collected by the developer layer on the second developing roller 8. For that reason, even when the developer layer used by the first developing roller 7 is reused by the second developing roller 8 as shown in FIG. 1, lack of developed image density can be avoided, which is different from a conventional image recording apparatus of electrophotography provided with a developing unit having a plurality of developing rollers.

In the developing unit shown in FIG. 2, the first and second developing rollers 7 and 8 are rotated in the opposite directions to each other, so that the developer layers are carried in opposite directions. Therefore, the second developing roller 8 forms a developer layer separately from the first developing roller 7. When the carrying direction of the developer layer of the first developing roller 7 and that of the second developing roller 8 are opposite to each other as described above, the orientation of development is complementary, so that the toner image can be uniformly formed.

In the example shown in the drawings, an OPC photoreceptor (an organic photoconductor) is adopted. In this photoreceptor, the electrical charge is generated and injected according to the following two mechanisms. In the following explanation, the electrical charge transfer layer 1*c* is of a positive hole transport type.

The first mechanism will be described as follows.

Figure 5:
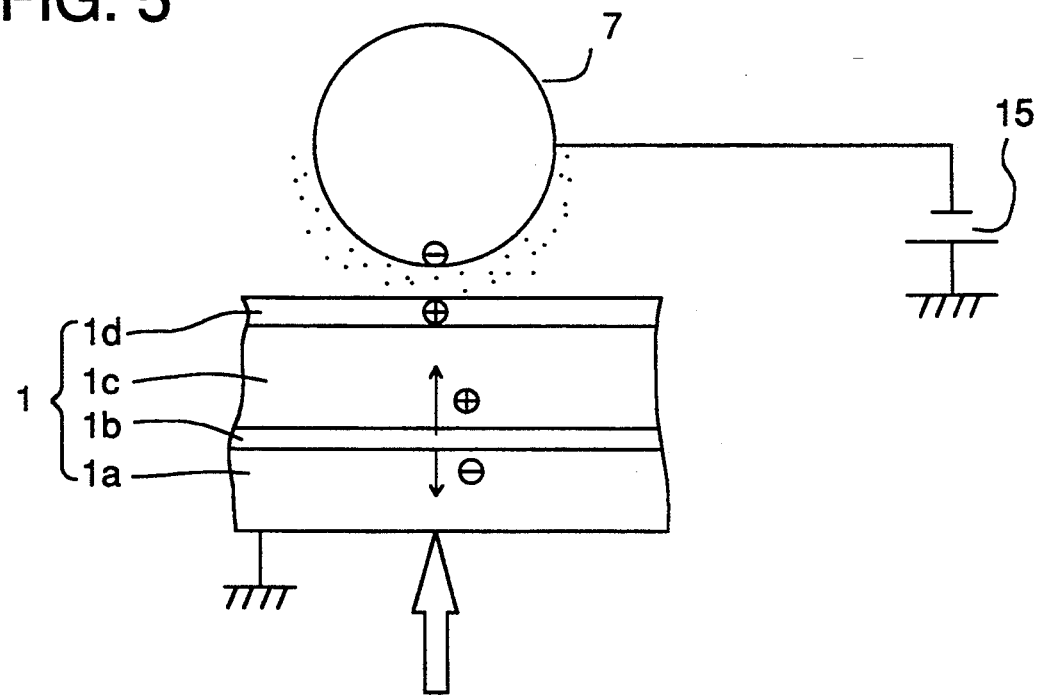
FIG. 5 is a schematic illustration of an image forming apparatus.

As shown in FIG. 5 that is a schematic illustration of the image forming section, the electrical charge generation layer 1*b* on the transparent electrode layer 1*a* side is used. In this case, a negative bias voltage is impressed upon the first developing roller 7, and a positive hole generated in a portion in the electrical charge generation layer 1*b* to which the image light is incident, is attracted and trapped onto the surface of the photoreceptor. Negative charged toner is used for the insulating toner and deposited on the photoreceptor surface.

The electrical charge generation layer 1*d* is provided on the surface of the photoreceptor for the purpose of erasing the positive electrical charge remaining on the surface by uniform exposure after the toner image has been transferred and the surface of the photoreceptor has been cleaned. When the electrical charge generation layer 1*d* is uniformly irradiated with light from the inside or the outside of the photoreceptor, an electrical charge is generated, so that the trapped positive electrical charge is released. The uniform exposure means for the release operation may be provided inside or outside of the photoreceptor.

The second mechanism will be described as follows.

Figure 6:
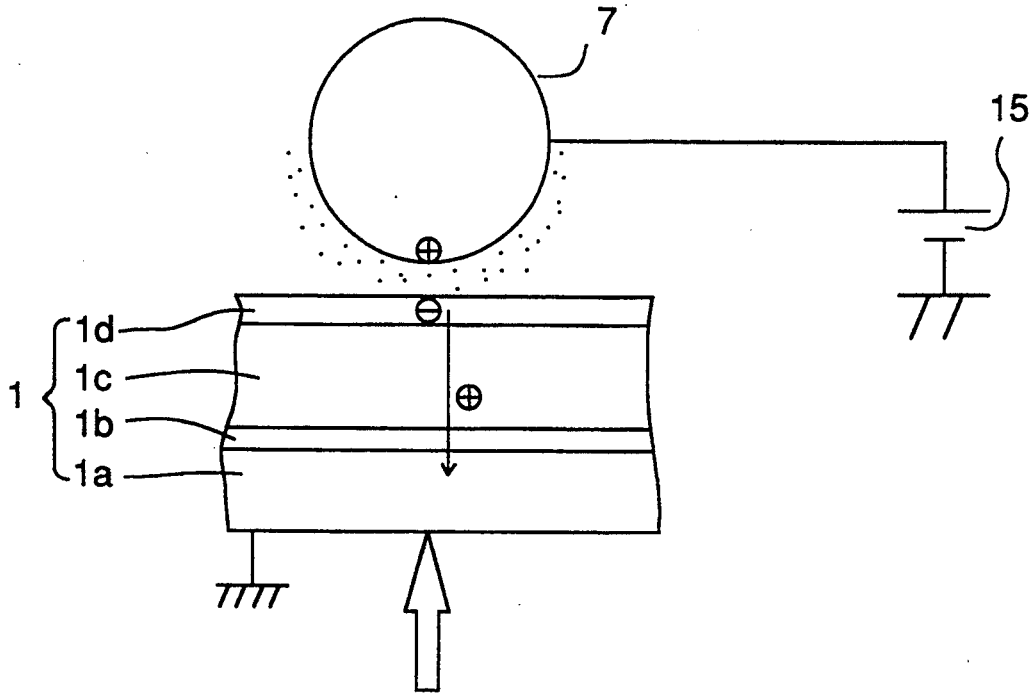
FIG. 6 is another schematic illustration of an image forming apparatus.

As shown in FIG. 6 that is a schematic illustration of the image forming section, the electrical charge generation layer 1*d* on the surface layer is used. In this case, a positive bias voltage is impressed upon the first developing roller 7, and a positive hole generated in a portion in the electrical charge generation layer 1*d* to which the image light is incident, is released to the transparent electrode layer 1*a* side so that the negative electrical charge is trapped on the photoreceptor surface. Positive charged toner is used for the insulating toner and deposited on the photoreceptor surface.

The electrical charge generation layer 1*b* is provided on the transparent electrode 1*a* side for erasing the negative electrical charge remaining on the surface after transfer and cleaning by uniform exposure. When the electrical charge generation layer 1*b* is uniformly irradiated with light from the inside or the outside of the photoreceptor, the positive electrical charge generated on the electrical charge generation layer 1*b* is moved onto the surface and neutralizes the trapped negative electrical charge.

In the case where the photoconductive layer of a photoreceptor is composed of a single layer and by which the electrical charge of both polarities can be carried, a voltage of both polarities can be used for the bias voltage of the first developing roller 7. However, since much image light is absorbed on the photoreceptor base side, the bias voltage is preferably impressed, giving consideration to the grade of transfer of the positive hole of electrons in the photoconductive layer in the same manner as the aforementioned first mechanism.

It is possible to use the structure of photoconductive layers in which an electrical generation layer is provided on one side of the electrical charge transport layer in the same manner as a conventional OPC, however, in this case, there is a tendency that the electrical charge is not erased even when the layer is uniformly irradiated with light.

In the example shown in the drawing, only DC bias voltage is impressed upon the first developing roller 7. However, it is preferable that an AC component is superimposed on the DC bias voltage as long as the AC component does not invert the polarity. In order to quickly move the electrical charge in the optical conductor, a high bias voltage may be impressed. However, when a high DC voltage is simply impressed, a breakdown is caused between the first developing roller 7 and the photoreceptor, and the electrostatic latent image is damaged. On the other hand, when a bias voltage including an AC component that does not invert the polarity is impressed, the electrical charge transport speed can be increased at a low speed that does not damage the electrostatic latent image. Further, the AC component vibrates the developer layer so that the toner can be uniformly deposited on the photoreceptor. In the case where the polarity has been inverted by superimposing the AC component, the efficiency of electrical charge transport is lowered. For that reason, the bias voltage should be impressed under the condition that the polarity is not inverted.

It is also preferable that an AC component is superimposed on the DC voltage with respect to the second developing roller 8. In this case, the developer layer is vibrated by the action of the AC component, so that the toner deposited on the nonimage portion of the photoreceptor can be effectively removed, and a clear toner image without any stains can be provided. In the case of the AC component added to the bias voltage to be impressed upon the second developing roller 8, even when the polarity is inverted, no problems are caused because the electrical charge has already been trapped.

In order to control toner charging and also to improve the efficiency in which the second developing roller 8 removes toner, it is preferable that the developer is composed of two components and the magnetic carrier is provided with insulating properties. Further, it is preferable that the magnetic carrier particles are made spherical. Spherical carrier particles can provide the following effects: toner and carrier are efficiently mixed; developer can be efficiently carried; and aggregation of toner and carrier can be prevented. The particle size of spherical magnetic carrier is preferably in a range from 30 to 80 μm. As a result of the foregoing, the bias voltage can be uniformly impressed upon the first developing roller 7.

When the average size of the magnetic carrier particles is too small, they tend to be deposited on the photoreceptor surface, and the efficiency is lowered when the toner is removed by the second developing roller 8. When the average size of the magnetic carrier particles is too large, the bristles of the magnetic brush formed by the developer layer become rough, and the concentration of toner in the bristles is lowered, so that the toner layer can not be uniformly formed on the first developing roller. Accordingly, the bias voltage can not be impressed uniformly. Further, the toner can not be completely removed by the second developing roller 8.

Examples of the material used for the aforementioned preferable magnetic carrier are as follows: a metal such as iron, chrome, nickel and cobalt; and a compound and alloy such as triiron tetraoxide, γ-ferric oxide, chrome dioxide, manganese dioxide, and ferrite, wherein the particles of the aforementioned ferromagnetic bodies are made spherical, or the surfaces of the ferromagnetic particles are coated with a resin such as styrene resin, silicon resin, fluorine resin, vinyl resin, ethylene resin, rosin resin, acrylate resin, polyamide resin, epoxy resin, and polyester resin. Alternatively, particles of resin in which fine particles of the magnetic body are dispersed, are made and subjected to an average size particle selection means of the prior art so as to select the particle size.

When the carrier particles are made spherical as described above, the following problems can be solved: One problem is that nonspherical carrier particles are oriented in the direction of the long axis when the carrier particles are magnetically attracted and when carrier particles are removed, because they are magnetized in the direction of the long axis. Another problem is that the carrier particles are provided with edge portions so that the electrical field concentrates on the edge portions and a breakdown is caused to damage an image formed on the photoreceptor.

Since the aforementioned problems can be solved, the occurrence of orientation can be avoided when toner is deposited and removed. Accordingly, high bias voltage can be impressed, and a clear toner image can be formed.

In order to provide the aforementioned effects, the magnetic carrier particles are preferably provided with insulating properties, and the resistivity of the spherical carrier particles is preferably not less than $10^8$ Ωcm, and more preferably not less than $10^{13}$ Ωcm.

The resistivity can be measured in the following manner: the particles are put into a container, the sectional area of which is 0.5 $cm^2$; then the particles are tapped; while a load of 1 $kg/cm^2$ is applied onto the particles, a voltage is impressed between the load and the bottom electrode so that an electrical field of 1000 V/cm can be generated; and the electrical current is measured at the moment.

In the case where the resistivity is low, electrical charges are given to the carrier particles when a bias voltage is impressed upon the first and second developing rollers 7 and 8, so that the carrier particles tend to be deposited on the photoreceptor surface, and further a breakdown of the bias voltage tends to be caused.

Requirements for the magnetic carriers are as follows: the magnetic carriers are made spherical in such a manner that the ratio of the long axis to the short axis is not more than 3; there are no projections such as a needle-like portion and an edge portion; and the resistivity is not less than $10^8$ Ωcm, and more preferably not less than $10^{13}$ Ωcm.

The aforementioned spherical magnetic carrier particles of high resistance coated with resin are manufactured in the following manner:

Configuration of the particles should be as spherical as possible. In the case of the carrier in which magnetic fine particles are dispersed, particles should be as fine as possible, and after dispersed resin particles have been formed, they are subjected to spherical processing, or dispersed resin particles are manufactured by the spray-dry-method.

Next, the properties of toner will be described as follows. When the average particle size of toner is reduced, the quantity of charged electricity of toner particles is qualitatively reduced proportionally to the square of the particle size, so that deposition force such as Van der Waals force is relatively increased. Therefore, it becomes difficult for the toner particles to separate from the carrier particles. Accordingly, the toner layer can not be sufficiently formed on the photoreceptor surface by the first developing roller 7, and the toner deposited in the nonimage region on the photoreceptor surface by the first developing roller 7 can not be easily removed when the developer layer on the second developing roller 8 rubs the toner, so that fogging or stains tend to be caused. In the case where the bias voltage of the first and second developing rollers 7 and 8 is DC, the aforementioned problems occur when the average size of toner particles is not more than 10 μm.

However, in the case where an AC component is added to the bias voltage, the toner deposited in the developer layer on the first developing roller 7 can be easily transferred onto the image and nonimage region on the photoreceptor surface by the action of vibration given electrically, so that a sufficient toner layer is formed on the photoreceptor surface, and the carrier is not transferred onto the photoreceptor surface. In this case, it is preferable that the bias voltage is determined so that the bias component of reverse polarity that prevents the electrical charge from transferring can not be given. The second developing roller 8 effectively removes the toner in the nonimage region on the photoreceptor surface that has been deposited by the action of vibration given electrically. Therefore, a clear toner image without fogging can be formed on the photoreceptor surface. Consequently, toner particles, the average particle size of which is several μm, can be used without causing any problems.

The same effects obtained when an AC component is added to the bias voltage can be provided in the case where magnetic or nonmagnetic one-component insulating developer is utilized. That is, in the aforementioned case, a uniform and sufficient toner layer is formed on the photoreceptor surface by the action of vibration given to the toner, and the toner in the nonimage region can be effectively removed, so that a clear toner image without fogging can be formed.

Concerning 2-component developer, it is preferable that the ratio of spherical carrier to toner is the same as that of conventional 2-component developer. When necessary, a fluidity improving agent to improve the fluidity of particles and a cleaning agent to clean the photoreceptor surface are mixed with the particles. Examples used for the fluidity improving agent are coloidal silica, titanium oxide and nonion surface active agent. Examples used for the cleaning agent are surface active agents such as fatty acid metallic salt, substitutional organic group silicon and fluorine.

The thickness of the developer layer formed on the first developing roller 7 and that on the second developing roller 8 shown in FIG. 2, are preferably determined to be a value so that the provided developer layers can be sufficiently scraped off by the layer thickness regulating blades 11 and 12 so as to be formed into a layer of uniform thickness. The gap between the first developing roller 7 and the photoreceptor surface, and that between the second developing roller 8 and the photoreceptor surface, are preferably 100 to 2000 μm. When the gap is reduced to a value smaller than that, it becomes difficult to form a uniform toner layer and to effectively remove a toner layer, and further the gap is clogged by the developer layer and toner image formation is stopped. When the gap far exceeds 2000 μm, the opposed electrode effect is lowered, and the electrostatic latent image and toner layer are not formed completely, and further the toner in the nonimage region can not be removed completely, so that an excellent image without fogging can not be formed.

As described above, in the case where the gap between the first developing roller 7 and the photoreceptor surface, and that between the second developing roller 8 and the photoreceptor surface are not appropriate, the thickness of the layer formed on the first developing roller 7 and that on the second developing roller 8 can not be controlled to be an appropriate value. However, when the gap is maintained in a range from 100 μm to 2000 μm, the thickness of the developer layer can be appropriately controlled.

The thickness of the developer layer is preferably set under the following condition: the developer layer comes into contact with a portion of the outer surface of the photoreceptor under the condition that an alternating electrical field is not impressed, wherein the portion of the outer surface corresponds to a portion of the inner surface on which image light is incident. As a result of the foregoing, the occurrence of scratched images and gray background can be prevented.

Specifically, a bias voltage is impressed upon the first developing roller 7 in the following manner: a DC voltage of 300 to 1500 V, the polarity of which is the same as that of the charged toner, and an AC voltage, the frequency of which is in a range from 2 KHz to 10 KHz, and preferably in a range from 5 KHz to 10 KHz, the voltage $V_{p-p}$ between the peaks of which is in a range from 200 V to 2000 V, are superimposed, wherein the AC voltage is determined so that the polarity can not be inverted.

A bias voltage is impressed upon the second developing roller 8 in the following manner: a DC voltage of 50 to 300 V, the polarity of which is inverse to the charged toner, and an AC voltage, the frequency of which is in a range from 1 KHz to 10 KHz, the voltage of which is in the same range as that of the first developing roller 7 or higher than that, are superimposed.

In this case, it is necessary that the frequency of the AC component of the bias voltage impressed upon the first developing roller 7 is sufficiently higher than the inverse number of the traveling time of the electrical charge that transfers in the photoconductive layer. Unless the frequency of the AC component of the bias voltage is set as described above, the transferring electrical charge is affected, and the transfer of the electrical charge can not be carried out uniformly. Therefore, the frequency of the AC component of the bias voltage impressed upon the first developing roller 7 is set a little higher.

With reference to FIGS. 1 and 2, reference numeral 17 is a transfer roller operated in the following manner: transfer sheet P conveyed by the timing roller 18 synchronously with a toner image formed on the photoreceptor drum 1, is brought into pressure contact with the outer surface of the photoreceptor drum 1 by the transfer roller 17; and the transfer roller 17 is given a transfer bias voltage, the polarity of which is inverse to that of the charged toner, so that the toner image is transferred onto transfer sheet P. Since insulating toner is used for the chargeless image forming apparatus of the present invention, the transfer efficiency can be remarkably improved by the bias voltage impressed upon the transfer roller 17 when the toner image is transferred onto transfer sheet P.

Numeral 19 is a scraper blade to scrape off paper dust and toner adhered on the surface of the transfer roller 17, and the scraped toner drops into the toner reservoir 20. Transfer sheet P onto which the toner image has been transferred is sent to a fixing means such as a thermal roller type fixing device so that the toner image can be fixed, and then transfer sheet P is discharged outside the apparatus.

Numeral 21 is a discharging exposure means that uniformly exposes the inner surface of the photoreceptor drum 1 on the downstream side of the transfer position in order to erase the electrical charge of the photoreceptor drum 1 and to allow the residual toner to be moved easily, wherein the discharging exposure means 21 is composed of an LED array or EL. Numeral 22 is a scraper blade that removes the residual toner from the surface of the photoreceptor drum 1 so that the toner can be returned to the developer reservoir 4. Due to the foregoing, a clear toner image without any stains can be formed and recorded.

It should be understood that the present invention is not limited to the specific example, and the scraper blade 22 and the discharging exposure means 21 may be omitted in the apparatus of the present invention. The reason why the scraper blade 22 and the discharging exposure means 21 can be omitted is as follows: the transfer efficiency is high when a toner image is transferred onto transfer sheet P by the transfer roller 17; and the developer layers on the first and second developing rollers 7 and 8 also serve as a scraper blade. In the case where the discharging exposure means 21 is omitted, a portion of the electrical charge remains on the photoreceptor, so that the image is affected.

A corona discharge electrode may be applied for the transfer means. The rod lens array may be omitted, and the LED or EL may be closely contacted with the inner surface of the photoreceptor so that image light can be incident on the photoreceptor surface.

According to the chargeless image forming apparatus of the present invention, a clear toner image without any stains can be formed, and efficiently transferred and recorded on a transfer sheet by means of electrical transfer.

Figure 7:
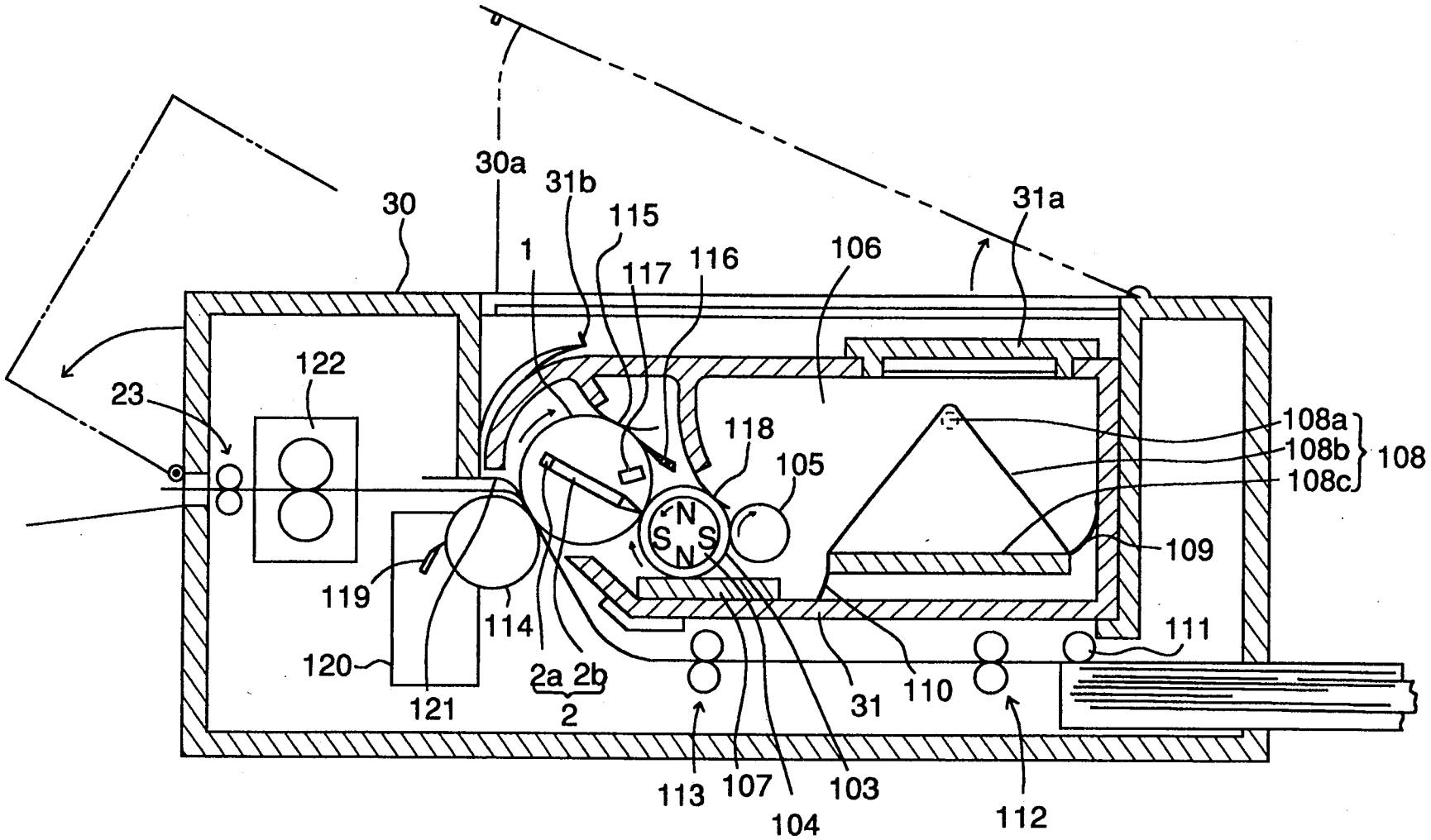
FIG. 7 is a schematic illustration showing the structure of an example of the image forming apparatus of the present invention.
Figure 8:
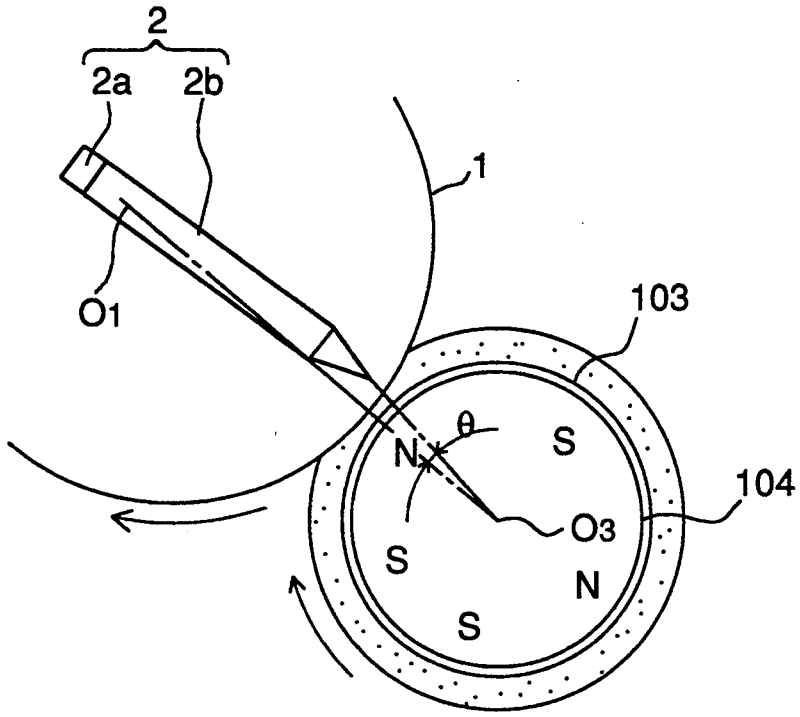
FIG. 8 is a partial enlarged view of FIG. 7.
Figure 9:
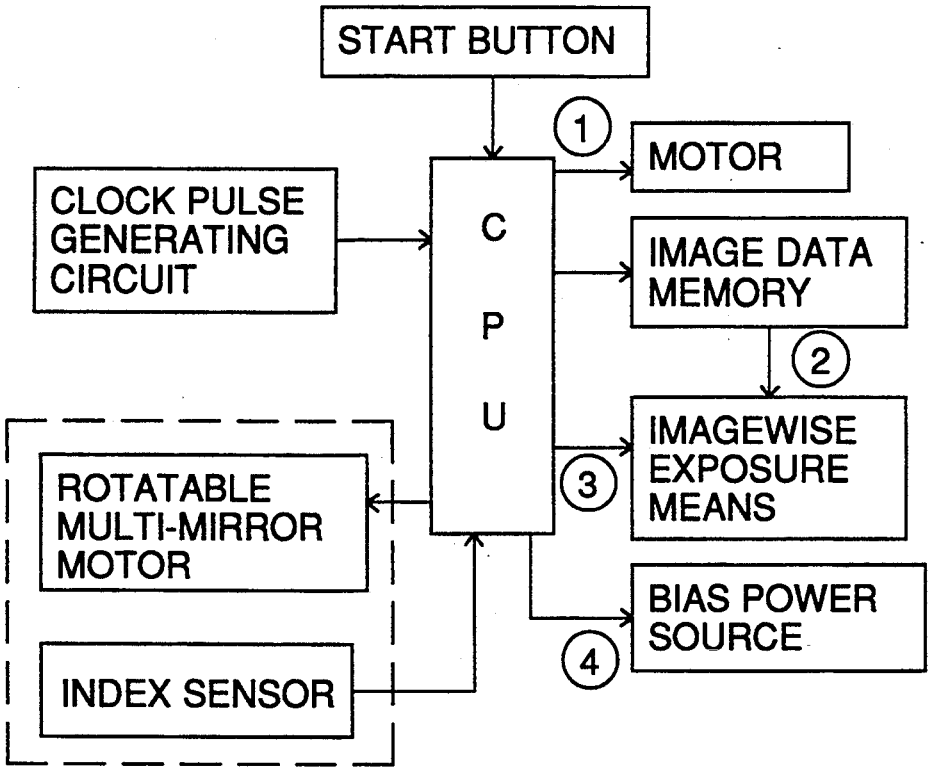
FIG. 9 is a block diagram of an essential portion of a control circuit.
Figure 10:
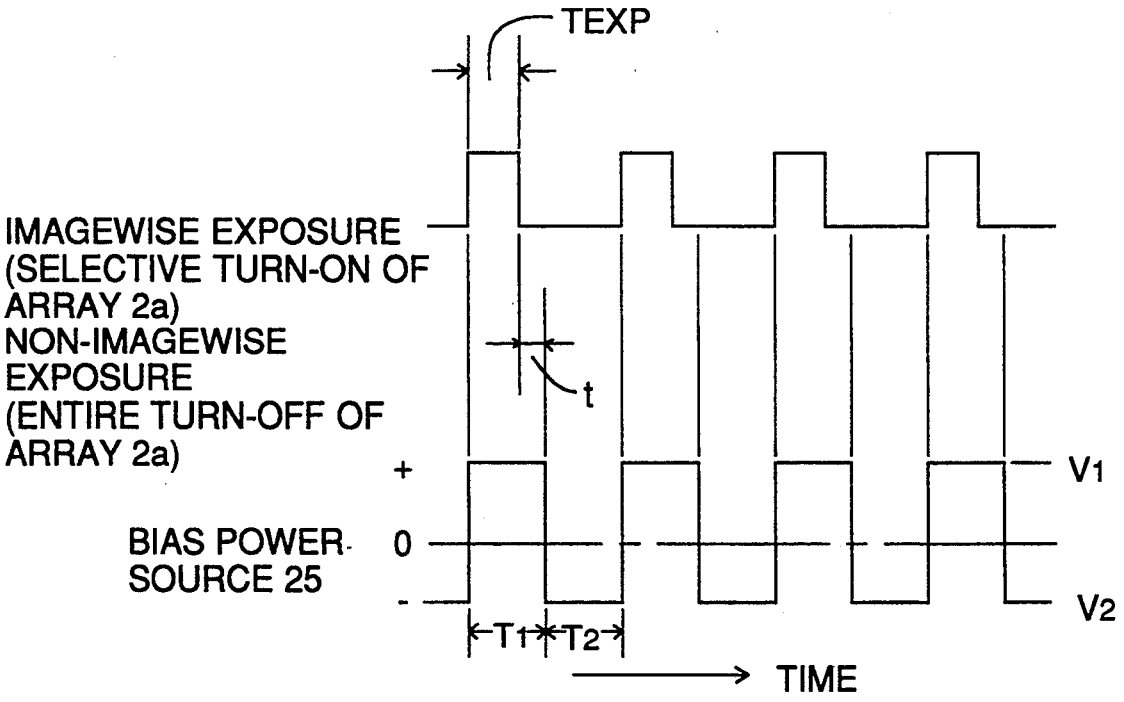
FIG. 10 is a timing chart showing the relation between the incidence of image light and the bias voltage of a developing roller.

FIG. 7 is a schematic illustration showing another example of the image forming apparatus of the present invention. FIG. 8 is a partial enlarged view of FIG. 7. FIG. 9 is a block diagram of an essential portion of a control circuit. FIG. 10 is a timing chart showing the relation between the incidence of image light and the bias voltage of a developing roller.

Numeral 1 shown in FIG. 7 is a photoreceptor drum that is rotated in the arrowed direction. As shown in FIG. 3, the photoreceptor drum 1 is composed of a photoconductive layer including a transparent electrode layer 1*a*, an electrical charge generation layer 1*b*, a positive hole electrical charge transport layer 1*c* and an electrical charge generation layer 1*d*. Numeral 2 is an image exposure means composed of a light emitting array 2*a* such as LED and EL and also composed of a convergent optical transmitter 2*b* such as a rod lens array, and the image exposure means 2 is stationarily provided inside the photoreceptor drum 1. Image light is incident upon the inner surface of the photoreceptor drum 1 in a direction perpendicular to the rotational direction of the photoreceptor drum 1. Numeral 103 is a developing roller made of nonmagnetic conductive material such as aluminum, wherein the N and S poles of the magnet 104 is circumferentially provided inside the developing roller 103.

By the magnetic force of the magnet 104, the developing roller 103 attracts 2-component developer composed of insulating toner and magnetic carrier, or 1-component developer composed of insulating magnetic toner, onto its surface. When one of the developing roller 103 and the magnet 104, or both the developing roller 103 and the magnet 104 are rotated in the arrowed direction, the developer is carried in the arrowed direction of the developing roller 103. As a result of the foregoing, the developer layer formed on the developing roller 103 is contacted with a portion on the outer surface of the photoreceptor drum 1, wherein the portion corresponds to a position on the inner surface on which image light is incident.

The relation between a line on the photoreceptor drum 1 where image exposure is repeatedly carried out by the image exposure means 2, and a position where the developer layer on the developing roller 103 comes into contact with the photoreceptor drum 1, is explained as follows. As shown in FIG. 8, angle $\theta$ is formed by two lines. One is a line that connects center $O_3$ of the developing roller 103 with center $O^1$ of the photoreceptor drum 1, and in the case of a belt-shaped photoreceptor, it is a line that connects center $O_3$ of the developing roller 103 with a point where the distance between the belt-shaped photoreceptor and the developing roller 103 is the shortest. The other is a line that connects center $O_3$ of the developing roller 103 with a point where image exposure is repeatedly carried out by the image exposure means 2. It is preferable that the position of the image exposure line is located on the upstream side with respect to the position where the distance between the developing roller 103 and the photoreceptor drum 1 is the shortest, wherein angle $\theta$ should be in a range of $-10° \leqq \theta \leqq 10°$ and more preferably in a range of $0° \leqq \theta \leqq 10°$. As a result of the foregoing, the electrical charge can be transferred in the photoconductive layer so as to form an electrostatic image on the photoreceptor drum 1 by the action of incidence of image light and a strong electrical field generated by the bias voltage of the developing roller 103. In the case where angle $\theta$ exceeds the aforementioned range, the intensity of the electrical field is lowered in the position of the image exposure line, so that the electrostatic latent image can not be sufficiently formed.

AC voltage of a rectangular waveform shown in FIG. 10 is impressed upon the developing roller 103 by the control circuit shown in FIG. 9. In this case, the aforementioned AC voltage of a rectangular wave-form is characterized in that: a positive constant voltage, the polarity of which is the same as that of the charged toner, is provided synchronously with image exposure repeatedly conducted along the line, which is the primary scanning direction, during the writing operation, wherein the image exposure is carried out by the image exposure means 2 when the light emitting array 2*a* is selectively turned on in accordance with image data; and a negative constant voltage, the polarity of which is inverse to that of the charged toner, is provided while the light emitting array 2*a* is entirely turned off in the period from the end of the previous writing to the start of the next writing. As a result of the foregoing, toner is deposited only in the portion on the photoreceptor drum 1 corresponding to the line portion where image exposure is conducted, and toner is not deposited on the nonexposure portion that is not irradiated with image light during writing and also during the interval of writing. Therefore, a clean toner image without any stains can be formed.

In the control circuit shown in FIG. 9, the CPU carries out a control operation in accordance with reference clock pulses generated by the clock pulse generation circuit as follows:

(1) Control of the drive motor to drive the photoreceptor drum 1
(2) Transfer and latching of image data corresponding to one scanning line from the image data memory to the image exposure means
(3) Image exposure timing control of the image exposure means
(4) Control of the bias power source to impress a rectangular wave AC bias voltage varying in time $T_1$ and $T_2$ synchronously with the image exposure timing as shown in FIG. 10, upon the developing roller 103

In the case where a laser optical system is applied to the image exposure means, the control units encircled by a dotted line in FIG. 9 are added into the control circuit. In the example shown in FIG. 10, the linear speed of the photoreceptor of 25 $\mu$m thickness was determined at 40 mm/sec. However, the layer thickness of the photoreceptor may be 10 to 50 $\mu$m, and the linear speed of the photoreceptor may be 10 to 300 mm/sec. Even when the operating conditions are set in the aforementioned range, it is possible to form clean toner images without stains.

In the example shown in the drawings, an OPC photoreceptor, the layer structure of which is shown in FIG. 3, was applied to the photoreceptor. There are two mechanisms when an electrostatic latent image and a toner image are formed on this photoreceptor. In this case, the electrical charge transfer layer 1*c* is of the positive hole transfer type.

Figure 11:
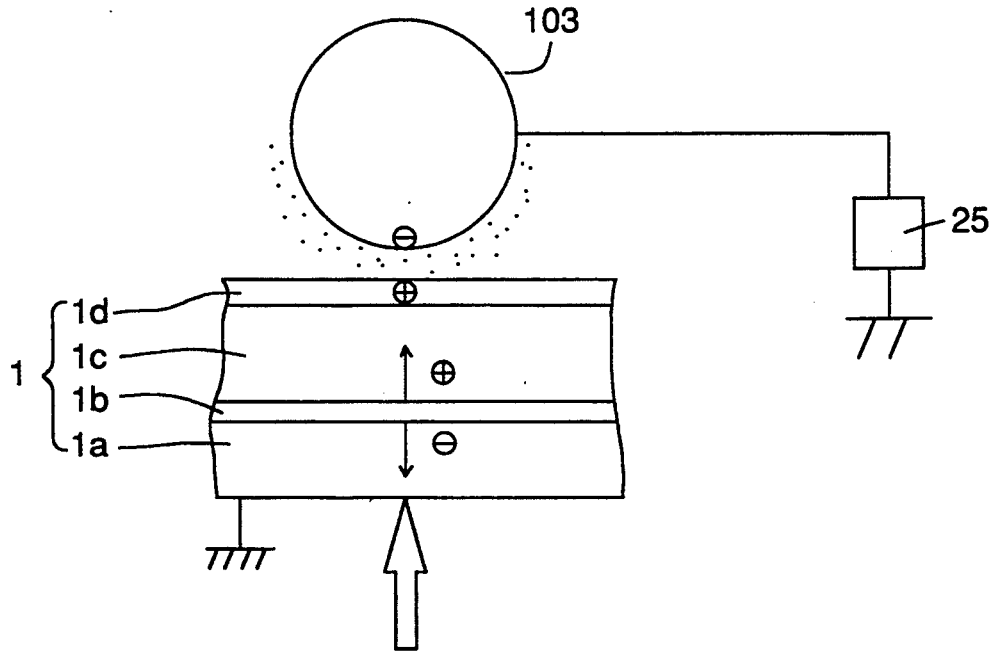
FIG. 11 is a schematic illustration showing a model of an image forming section; and, FIG. 12 is a schematic illustration showing a model of an image forming section.

As shown in FIG. 11 that is a schematic illustration of the image forming section, the electrical charge generation layer 1b on the transparent electrode layer 1a side is utilized in the first mechanism. In this case, the bias voltage of the developing roller 103 becomes negative during an image exposure operation conducted along the line, and a positive charge is given to the exposed portion on the photoreceptor. That is, a positive hole generated in a portion in the electrical charge generation layer 1b on which image light is incident, is attracted and trapped onto the surface of the photoreceptor. Negatively charged toner is used for the insulating toner, and the toner is deposited on the surface of the photoreceptor where the positive hole is trapped. The bias voltage of the developing roller 103 becomes positive in the period from image exposure conducted along the line to the next image exposure, and the toner deposited on the photoreceptor surface where the positive hole is not trapped, is attracted to the developing roller 103 side. As a result of the foregoing, a toner image without fogging can be formed on the photoreceptor surface. As described above, the inversion of bias voltage between positive and negative is carried out by the rectangular wave generation circuit 25. The developer layer is vibrated by this inversion so that the aforementioned toner image formation can be facilitated.

Figure 12:
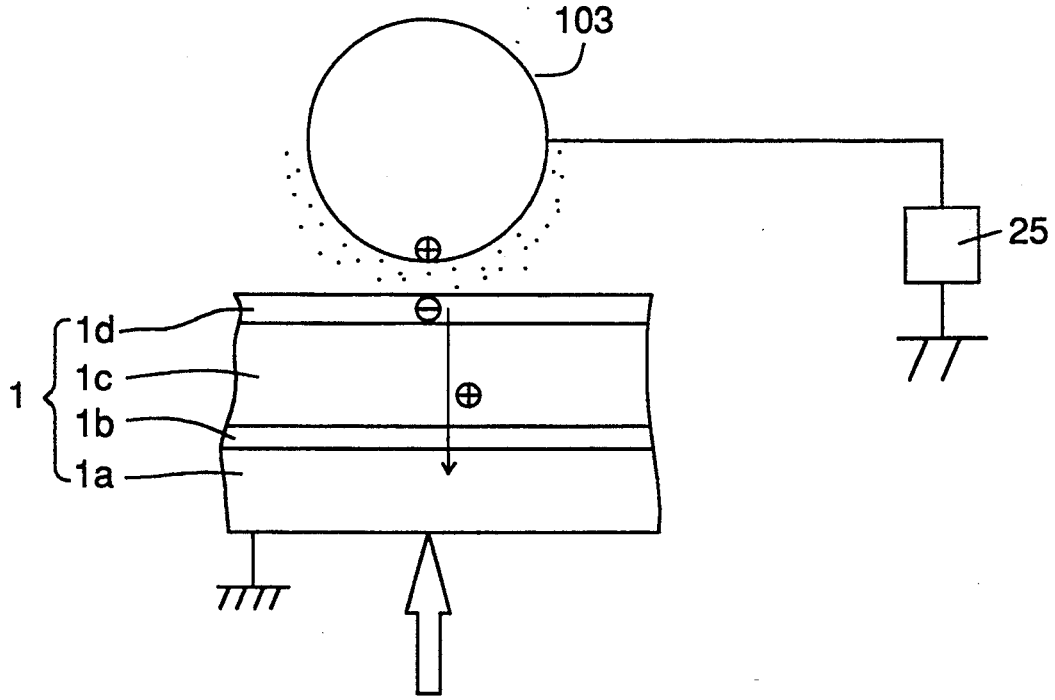

The second mechanism is shown in FIG. 12 that is a schematic illustration of the image forming section. As shown in the drawing, the electrical charge generation layer 1d on the photoreceptor surface is used for the second mechanism. In this case, the bias voltage of the developing roller 103 becomes positive during an image exposure operation carried out along the line, and negative charges are given onto the exposed portion on the photoreceptor. That is, a positive hole generated in the portion in the electrical charge generation layer 1d on which image light is incident, is released onto the transparent electrode 1a side so that the negative charge is trapped on the surface of the photoreceptor. In this case, positively charged toner is used for the insulating toner, and the toner is deposited on a portion of the photoreceptor surface where the negative charge is trapped. The bias voltage of the developing roller 103 becomes negative in a period between an image exposure operation carried out along the line and the next image exposure operation. Therefore, the toner deposited on a portion of the photoreceptor surface where the negative electrical charge is not trapped, is attracted onto the developing roller side 103. As a result of the foregoing, a toner image without fogging can be formed on the surface of the photoreceptor.

FIG. 7 shows a case in which 1-component magnetic toner is used. Numeral 105 is a developer supply member such as a sponge roller that supplies the developer from the developer chamber 106 onto the surface of the developing roller 103. Numeral 107 is a layer thickness regulating member such as a rubber plate that regulates the thickness of a developer layer conveyed by the developing roller 103. Numeral 108 is an oscillating feed member composed of the shaft 108a, side plate 108b and bottom plate 108c. The oscillating member 108 conveys the developer in the developer chamber 106 to the side of the developer supply member 105 in the following manner: the oscillating feed member 108 is oscillated slowly in the direction of the developer supply member 105 when the shaft 108a is rotated by a drive means not shown; and the oscillating feed member 108 is oscillated quickly in the reverse direction. Numerals 109 and 110 are flexible sheets provided on the bottom plate 108c of the oscillating feed member 108 so as to prevent the developer from entering a space between the oscillating feed member 108 and the back or bottom wall of the developer chamber 106.

Triboelectricity is given to the toner by the action of the developer feed member 105, the layer thickness regulating member 107 composed of a rubber plate, and the developing roller 103. However, it is possible to provide a rotary stirring blade instead of the oscillating feed member 108 so as to give the triboelectrical charge to the toner and also to supply the developer to the developing roller 103. In this case, the developer supply member 105 can be omitted. Also, the layer thickness regulating member 107 may be replaced with a doctor blade. The gap formed between the photoreceptor and the developing roller 103 is set at 30 to 500 μm.

In the case where 1-component nonmagnetic developer is used, a toner image can be satisfactorily formed under the following conditions: a developer layer is formed on the surface of the developing roller 103 so that toner particles of 1 to 2 layers can be provided; and the developer layer is contacted with the surface of the photoreceptor. In that case, the gap between the surface of the photoreceptor and that of the developing roller 103 becomes 5 to 50 μm, which agrees with the thickness of toner layer. Under the aforementioned condition, a strong electrical field for development can be formed in the gap, so that the electrical charge can be effectively transferred in the photoconductive layer during image exposure. Therefore, an excellent toner image can be provided.

In the case where 2-component developer is used, the thickness of a developer layer formed on the developing roller 103 should be determined to be a value at which toner can exist uniformly in the layer. Therefore, the gap between the developing roller 103 and the photoreceptor drum 1 is preferably 50 to 1000 μm. When the gap becomes smaller than 50 μm, the toner is nonuniformly dispersed in the developer layer. Accordingly, it becomes difficult to provide a toner image of sufficient density, and further the gap is clogged with the developer layer. When the gap becomes larger than 1000 μm, the opposed electrode effect is lowered, so that it becomes difficult to form a satisfactory electrostatic latent image and a toner image, and further a toner image without fogging can not be provided.

The bias voltage of the developing roller 103 shown in FIG. 10 will be further explained as follows.

In order to prevent the occurrence of fogging, it is preferable that the bias voltage impressed upon the developing roller 103 includes a DC component of a polarity reverse to that of the charged toner, the average voltage of which is 20 to 200 V. While image exposure is being carried out along the line, it is preferable that the electrical charge in the photoconductor layer is effectively transferred by high voltage V1, the polarity of which is the same as that of the charged toner. It is necessary to maintain this high voltage until the transfer of the electrical charge is completed. It is preferable that the aforementioned conditions are satisfied. Therefore, it is preferable that the inequality $|V_1| \geqq |V_2|$ is satisfied where $V_1$ is the voltage for transferring the electrical charge and $V_2$ is the voltage for preventing the occurrence of fogging.

However, under the aforementioned condition, the polarity of the average DC component of the bias voltage of the developing roller 103 becomes the same as that of the charged toner, and the value of the DC component is increased, so that fogging tends to occur all over the image. That is, in the case where $|V_1<|V_2|$, there is no problem even when $T_1=T_2$ where $T_1$ is the continuation time of $V_1$, and $T_2$ is the continuation time of $V_2$. However, in the case where $|V_1|\geqq|V_2|$, it is necessary to be $T_1<T_2$. That is, it is preferable that $V_1$, $V_2$, $T_1$ and $T_2$ are determined so that the average voltage includes a DC component, the polarity of which is reverse to that of the charged toner.

Time difference t is important, that is difference of time between the time when image exposure along the line has been completed and the time when the bias voltage is changed over from $V_1$ to $V_2$. The aforementioned time difference t must be longer than the time necessary for the last charge generated in the photoconductive layer by image exposure to be transferred. Especially, in the case of an OPC photoreceptor, the electrical charge transfer speed is slow, so that it is necessary to determined this time t sufficiently long. That is, it is preferable that time difference t is determined so as to satisfy the following inequality:

$$T_1-T_{exp}=t>0$$

where $T_{exp}$ is the exposure time, and $T_1$ is the continuation time.

As a result, when consideration is given to the transfer speed of an electrical charge, the frequency of bias voltage is preferably 10 Hz to 5 KHz in the case of image exposure, that is, in the case of writing. More preferably, the frequency of bias voltage is 10 Hz to 3 KHz. On the other hand, the bias voltage is used in the operation of development. Therefore, when a low frequency is applied, nonuniformity is caused in the development pitch. As a result of the foregoing, the most preferable range of frequency is from 100 Hz to 5 KHz from the viewpoint of practical use. Since the writing operation and the development bias voltage are synchronized, the recording speed to form a clear toner image at this frequency is restricted.

Bias voltage $V_1$ to be impressed upon the developing roller 103 is preferably 200 to 2000 V, and more preferably 300 to 1000 V, and the polarity of the bias voltage is the same as that of the charged toner. Bias voltage $V_2$ is preferably 50 to 1500 V, and more preferably 50 to 700 V, and the polarity of the bias voltage is reverse to that of the charged toner.

In FIG. 7, numeral 111 is a feed roller to feed a transfer sheet accommodated in a paper cassette. Numeral 112 denotes a pair of conveyance roller that pinch the transfer sheet sent by the feed roller 111. Numeral 113 denotes a pair of timing roller that convey the transfer sheet at timing when a toner image formed on the photoreceptor drum 1 is transferred onto the transfer sheet. Numeral 114 denotes a transfer roller that presses the transfer sheet sent by the timing roller 113 against the photoreceptor drum 1 so that the toner image on the photoreceptor drum 1 is transferred onto the transfer sheet. A transfer bias voltage, the polarity of which is reverse to that of the charged toner, is impressed upon the transfer roller 114 by an electric power source not shown in the drawing.

In the chargeless image forming apparatus according to the present invention, the toner is provided with insulating properties. Accordingly, the transfer efficiency can be remarkably improved by the bias voltage impressed upon the transfer roller 114 when a toner image is transferred onto a transfer sheet. Instead of the transfer roller, a corona discharge electrode may be used for the transfer means.

Numeral 115 is a flexible sheet softly coming into contact with the outer surface of the photoreceptor drum 1 so that the residual toner on the photoreceptor drum 1 can be easily scraped off by the scraper blade 116 disposed on the downstream side and further the electrical charge on the photoreceptor surface can be grounded. Numeral 117 is a discharge exposure means composed of an LED array or EL that uniformly exposes a portion of the inside of the photoreceptor drum, wherein the portion corresponds to a position where the scraper blade 116 is contacted with the outer surface of the photoreceptor drum 1, and the portion also corresponds to the upstream side of the aforementioned contacting position.

Since the scraper blade 116 and the flexible sheet 115 are provided, a cleaner toner image without stains can be formed by the action of the discharge exposure means. In order to improve the transfer efficiency, not only the flexible sheet 115 but also the scraper blade 116 and the discharge exposure means 117 may be provided. In the case where the scraper blade 116 is omitted, the developing roller 103 also serves as a cleaner. In the case where the discharge exposure means 117 is omitted, a portion of the electrical charge remains on the photoreceptor, and the remaining Charge affects the image. Therefore, when the discharge exposure means 117 is omitted, care is needed.

After toner has been scraped off from the surface of the photoreceptor drum 1 by the scraper blade 116, it drops on the developing roller 103 or the developer supply member 105. Then, the toner is conveyed by the developing roller 103 together with the developer layer that has passed through the developing region, and also conveyed by the developer supply member 105, and returned to the developing chamber 106 to be reused. Numeral 118 is a partition wall made of a flexible sheet that allows the recirculating developer to pass from the developing roller 103 to the developer chamber 106, and prevents the developer from scattering from the developer chamber.

Numeral 119 is a scraper blade that removes the toner and paper dust deposited on the transfer roller 114 so that the removed toner is dropped into the recovery container 120. Numeral 121 is a transfer sheet guide for preventing a transfer sheet from being wound around the photoreceptor drum 1, wherein the tip of the transfer sheet guide comes into contact with both side portions on the outer surface of the photoreceptor drum 1, both side portions being located outside of the image forming region of the photoreceptor drum 1, the transfer sheet guide being mounted on the main flame 30 of the image forming apparatus or on the frame 31 of the image forming unit that will be described later. Of course, the transfer sheet guide forms a transfer sheet passage in order to prevent a transfer sheet from being wound around the conveyance rollers.

A transfer sheet onto which a toner image has been transferred is sent to the thermal roller fixing device 122 so that the toner image can be fixed. After that, the transfer sheet is discharged to the outside of the main frame 30 by the discharge roller 23.

In the image forming apparatus shown in FIG. 7, the photoreceptor drum 1 having the image exposure means 2, the cleaning means, the developing roller 103 and the means to form a developer layer on the developing roller are integrally mounted on the image forming unit frame 31 in such a manner that the image forming unit frame 31 can be detachably provided to the main frame 30. When the door 30*a* provided on the roof of the main frame 30 is opened, the image forming unit frame 31 can be taken upward, or the image forming unit frame 31 can be set downward.

Numeral 31*a* is a cover of the developer replenishing hole through which developer is replenished to the developer chamber 106. Numeral 31*b* is a slide type protective cover that covers the outer surface of the photoreceptor drum 1 when the image forming unit frame 31 is taken out from the main frame 30.

The present invention is not limited to the specific example. The rod lens array may be omitted from the image exposure means, and the LED and EL array may be directly approached to the inner surface of the photoreceptor so as to conduct image exposure. Further, the image forming unit 31 may be taken out to the rear wall side of the main frame 30, that is, the image forming unit 31 may be taken out to the side opposite to the fixing unit 122. Furthermore, the photoreceptor drum 1 and the developing unit may be directly mounted on the main frame 30. As described before, the photoreceptor 1 may be replaced with a photoreceptor belt.

In the case where a photoreceptor belt is used, it is easy to apply a laser optical system to the image exposure means 2. In the laser optical system, a laser beam modulated in accordance with the image data scans the inner surface of the photoreceptor belt, using a rotational polygonal mirror and other units. Also, in the case of the laser scanning system, the bias voltage to be impressed upon the developing roller 103 is a rectangular wave AC voltage characterized in that: the AC voltage is constant and its polarity is the same as that of the charged toner during the period $T_1$ that is the sum of $T_{exp}$ and t, wherein $T_{exp}$ is a period of time in which a laser beam conducts image exposure on the line corresponding to the image portion with one of the surfaces of the rotational polygonal mirror, and wherein t is a period of time that follows the aforementioned period of time $T_{exp}$; and the AC voltage is constant and its polarity is reverse to that of the charged toner during the period $T_2$, wherein $T_2$ is a period of time from the end of period $T_1$ to the start of image exposure of the line conducted by the successive surface of the rotational polygonal mirror. As a result of the foregoing, a clean toner image without stains can be formed.

In this case, the control circuit shown in FIG. 9 is operated in the following manner:

The CPU including the circuits encircled by a dotted line illustrated in FIG. 9 controls the rotational speed of the rotational polygonal mirror using clock pulses sent from the clock pulse generating circuit. Then, the CPU controls timings $T_1$ and $T_2$ of image exposure and bias voltage in accordance with the information of the rotational phase of the rotational polygonal mirror detected by the index sensor.

According to the chargeless image forming apparatus of the present invention, a clear toner image without stains can be formed on the surface of the photoreceptor, and the formed image can be efficiently transferred on a transfer sheet by means of electrical transfer.

What is claimed is:

1. An image forming apparatus for forming an image from developer including toner provided with a charge, the image forming apparatus comprising:

(a) a photoreceptor;

(b) exposure means for imagewise exposing an inner surface of said photoreceptor during rotation thereof;

(c) a first developing roller to which a direct current voltage having a polarity the same as that of the toner charge is applied, the first developing roller carrying a developer layer thereon, wherein the first developing roller carries the developer layer into contact with an outer surface of said photoreceptor which has been subjected to the imagewise exposure so that the toner is adhered to a non-exposed portion and an exposed portion of the photoreceptor to form a toner layer on the outer surface of said photoreceptor; and (d) a second developing roller to which a direct current voltage having a polarity reverse to that of said first developing roller is applied, the second developing roller carrying a developer layer thereon, wherein the second developing roller carries the developer layer into contact with the outer surface of said photoreceptor where the toner layer has been formed so that the toner adhered to the non-exposed portion is removed from the photoreceptor and the toner adhered to the exposed portion remains on the photoreceptor to form the toner image;

wherein an alternating current voltage superimposed on the direct current voltage is applied to one of the first developing roller and the second developing roller.

2. The image forming apparatus of claim 1, wherein the developer layer carried by said first developing roller is carried in the same direction as the developer layer carried by said second developing roller, and further wherein the developer layer carried by said first developing roller passes in contact with the outer surface of said photoreceptor to form the toner layer and then moves onto said second developing roller so as to form the developer layer carried by the second developing roller and contact the outer surface of said photoreceptor to form the toner image.

3. The image forming apparatus of claim 1, wherein the developer layer carried by said first developing roller is carried in a direction reverse to that of the developer layer carried by said second developing roller.

4. The image forming apparatus of claim 1, wherein an alternating current is applied to each of the first developing roller and the second developing roller, and further wherein the direct current voltage and the alternating current voltage applied to said first developing roller are respectively in the range from 300 to 1500 volts and from 200 to 2000 volts in peak to peak with a frequency from 5 KHz to 10 KHz, and the direct current voltage and the alternating current voltage applied to said second developing roller are respectively in the range from 50 to 300 volts and a voltage not less than the alternating current voltage of said first developing roller with a frequency from 1 KHz to 10 KHz.

5. The image forming apparatus of claim 1, wherein the developer comprises at least two components including an insulating magnetic carrier which is substantially spherical in shape, the average diameter of the carrier being in the range from 30 to 80 μm, and electrical resistivity of the carrier being not less than $10^{13}\Omega$ cm.

6. The image forming apparatus of claim 1, wherein the first developing roller and the second developing roller are positioned to provide gaps between the outer surface of said photoreceptor and each of said first developing roller and said second developing roller, respectively, through which the developer layers are carried, the gaps being in the range from 100 to 2000 μm.

7. The image forming apparatus of claim 1, wherein an angle $\theta$ formed between a line connecting a position where the distance between the surface of said first developing roller and the surface of said photoreceptor is shortest with the center of said first developing roller, and a line connecting an incidence position of said exposure means with the center of said first developing roller is $0 \leqq \theta \leqq 20°$ and further wherein the incidence position of said exposure means is located upstream of said shortest distance position.

8. An image forming apparatus comprising:

(a) a photoreceptor;

(b) exposure means for repeatedly imagewise exposing an inner surface of said photoreceptor along a line substantially perpendicular to a rotating direction of said photoreceptor; and (c) developing means having a developing roller to which a bias voltage is applied and on which a developer layer is formed opposite to an outer surface of said photoreceptor corresponding to said line to form a toner image, the developer layer formed from developer including insulating toner provided with a charge, wherein the bias voltage has a polarity the same as that of the toner charge and is applied in synchronization with the repetition of imagewise exposure during a period in which imagewise exposure operation is being conducted, and further wherein an alternating current voltage having a polarity reverse to the toner charge is applied during a period between imagewise exposure operations.

9. The image forming apparatus of claim 8, wherein said photoreceptor comprises, from the inner surface to the outer surface, a transparent conductive layer, a first charge generating layer, a charge transporting layer and a second charge generating layer, respectively.

10. The image forming apparatus of claim 8, further comprising neutralizing means for neutralizing said photoreceptor at a position downstream of a position where a recording sheet transfer operation occurs and upstream of a position where the exposure operation occurs.

11. The image forming apparatus of claim 8, wherein the alternating current voltage has a rectangular wave.

12. The image forming apparatus of claim 8, wherein the bias voltage during the period of imagewise exposure operation is in the range from 300 to 1,000 volts with a frequency from 100 HZ to 3 KHz, and the alternating current voltage during the period between imagewise exposure operations is in the range from 50 to 700 volts.

13. The image forming apparatus of claim 8, wherein an angle $\theta$ formed between a line connecting a position where the distance between the surface of said developing roller and the surface of said photoreceptor is shortest with the center of said developing roller, and a line connecting an incidence position of said exposure means with the center of said developing roller is $-10° \leqq \theta \leqq 10°$ and further wherein the incidence position of said exposure means is upstream of said shortest distance position.

* * * * *